US011905083B2

(12) United States Patent
Stanek

(10) Patent No.: US 11,905,083 B2
(45) Date of Patent: Feb. 20, 2024

(54) CAPS FOR PAINT CONTAINER LIDS

(71) Applicant: Joseph R Stanek, Orchard Park, NY (US)

(72) Inventor: Joseph R Stanek, Orchard Park, NY (US)

( * ) Notice: Subject to any disclaimer, the term of this patent is extended or adjusted under 35 U.S.C. 154(b) by 157 days.

(21) Appl. No.: 17/487,488

(22) Filed: Sep. 28, 2021

(65) Prior Publication Data

US 2023/0102427 A1 Mar. 30, 2023

Related U.S. Application Data

(63) Continuation-in-part of application No. 29/809,462, filed on Sep. 28, 2021.

(51) Int. Cl.
*B65D 51/18* (2006.01)
*B65D 41/04* (2006.01)

(52) U.S. Cl.
CPC ..... *B65D 51/18* (2013.01); *B65D 41/0485* (2013.01); *B65D 2251/0015* (2013.01); *B65D 2251/0078* (2013.01)

(58) Field of Classification Search
CPC ..... B65D 51/18; B65D 41/0485; B65D 2251/0015; B65D 2251/0078; B65D 39/082
USPC ..... 215/302, 305; 220/284
See application file for complete search history.

(56) References Cited

U.S. PATENT DOCUMENTS 366,434 A * 7/1887 Sowers ..... B65D 39/082 217/107
1,737,605 A * 12/1929 Mauser ..... B65D 39/088 220/309.2
D136,659 S * 11/1943 Janning ..... D9/439
2,772,017 A 11/1956 Rieke
3,432,070 A * 3/1969 Dubois ..... B65D 77/06 220/745
4,337,870 A * 7/1982 Keeler ..... B65D 41/3409 264/156
4,441,622 A 4/1984 Von Holdt
4,494,664 A * 1/1985 Guala ..... B65D 41/3409 215/258
4,706,838 A 11/1987 Von Holdt
D315,102 S * 3/1991 Chandler ..... D6/702
5,211,289 A 5/1993 Matthews
D342,448 S * 12/1993 Ritcey ..... D9/443
5,314,061 A 5/1994 Bedrossian
5,660,302 A 8/1997 Trout
5,799,813 A 9/1998 Letica
5,842,593 A 12/1998 Von Holdt
6,390,315 B1 * 5/2002 Giddings ..... B65D 47/088 220/849
6,571,972 B1 6/2003 Bouc et al.
7,380,683 B1 6/2008 Oberhofer et al.
7,584,866 B2 9/2009 Selina et al.
7,607,551 B2 10/2009 Coughlin et al.
D765,508 S 9/2016 Wu
(Continued)

*Primary Examiner* — James N Smalley
(74) *Attorney, Agent, or Firm* — Reed Smith LLP; Lisa A. Chiarini; Richard J. Brown

(57) ABSTRACT

Disclosed are caps for closing an opening in a lid for a container, such as a paint can or bucket, wherein the caps comprises top walls comprising on their top surfaces centrally disposed recesses configured to receive a tool to rotate the caps; and threaded cylindrical projections on their bottom surfaces.

19 Claims, 12 Drawing Sheets

(56) References Cited

U.S. PATENT DOCUMENTS

| | | | | |
|---|---|---|---|---|
| 10,968,036 | B2 | 4/2021 | Weissbrod | |
| 11,242,179 | B2 | 2/2022 | Taylor et al. | |
| 2007/0045219 | A1* | 3/2007 | Nasiatka | B65D 1/02 215/305 |
| 2018/0194522 | A1* | 7/2018 | Foley | B65D 41/0485 |

* cited by examiner

CAPS FOR PAINT CONTAINER LIDS

FIELD OF THE DISCLOSED SUBJECT MATTER

This disclosure relates in general to plugs and closures which are selectively removable from their corresponding containers.

BACKGROUND OF THE DISCLOSED SUBJECT MATTER

More specifically, this disclosure relates to designs of molded plastic plugs or caps for use with five-gallon (20 liter) or 1-gallon (4 liter) containers which contain liquid products such as a paint or stain product. Five-gallon (20 liter) containers (buckets) are typically used for non-tinted base paint products. These containers have lids having an outlet opening which is closed by a suitable tint plug or cap. When a painter acquires the initially filled container, the tint plug is removed and a paint tint is added. The tint plug is reinstalled, the paint constituents in the container are mixed, and the container is then transported to the job site. Recently, some 1-gallon (4 liter) paint cans have been sold with lids having similar openings. In some instances, these five-gallon paint containers (pails) are used by professional painters where the entire container with the lid removed adapts to their automatic paint application equipment. In other instances with either size container, a painter may remove the tint plug and pour out some of the paint to another container such as a roller tray and then reseal the port with the tint plug. When paint is poured out of the port, some of the paint can adhere to the inner surface of the port opening. When the paint dries inside the opening, it can prevent proper sealing of the plug or cap or it can act as an adhesive that "glues" the plug or cap into the opening, which makes it more difficult to subsequently remove.

Conventional paint bucket lids generally comprise two types of tint ports and complementary closures. In the first type, the port comprises a circular outlet opening of unitary construction with the remainder of lid and is of a molded plastic construction, and the outlet opening is shaped with a smooth inner surface. The center portion of the lid has a substantially uniform thickness whose axial dimension coincides with the axial length of the opening. The port closure comprises a port plug comprising a generally planar bottom wall, a sidewall circumferentially disposed around the bottom wall wherein the bottom wall and the sidewall form a cup-shaped plug that can be friction-fitted into the opening of the lid, and a pull fitting that provides a handle that a user engages to pull and pry the port plug out of the opening in the lid. Typically the pull fitting is a loop that is attached to the bottom wall and/or the side wall of the port lug and can nest in the cup formed by the bottom wall and the sidewall. In instances where paint has adhered the plug to the lid, the force required to remove the port plug can be large enough to break the pull fitting where it attaches to the port plug. This can make it even more difficult to remove the port plug.

In the second type, the lid comprises a well around a circular outlet opening surrounded by a raised collar having a screw thread on the outside surface of the collar configured to releasably engage a complementary threaded element of a port cap. The cap comprises a generally circular top wall and a generally cylindrical sidewall connected to the top wall, wherein the cylindrical sidewall has an inner threaded surface for threading to the threaded collar opening. A user grasps the outside of the sidewall and rotates the cap in a first direction to disengage the threads to open the port, or rotate the cap in the opposite direction to engage the threads and close the port. Because the lid is required to support the weight of additional buckets on top, the well of the lid tends to be shallow and closely proximate to the outer surface of the cap, making it difficult for a user to grasp the cap when it closes the opening.

Some of the problems with existing tint plug designs are that the plugs do not stay securely in the outlet opening when they are supposed to and/or the plugs are difficult to remove. There needs to be a balance established between a tight fit for leak-proof handling and easy removal for the convenience of the user. The plug must remain secured in the outlet opening and establish a leak-proof seal during normal shipping and handling. The user, who may be unskilled, needs to be able to easily remove the tint plug without splashing paint which will be on the inside surface of the tint plug. Additionally, the tint plug must be easily reinstalled and effect a seal for transport between the tinting location and the job site.

It is desirable to develop tint port caps that solve these problems.

SUMMARY OF THE DISCLOSED SUBJECT MATTER

Disclosed is a cap for closing an opening in a lid for a container wherein the cap comprises a generally circular top wall having a top surface and a bottom surface, wherein the top surface comprises a centrally disposed recess configured to receive a tool to rotate the cap; and a cylindrical projection on the bottom surface comprising a screw thread configured to engage a complementary surface at the perimeter of the opening in the lid.

Embodiments of the cap include the following, alone or in any combination.

The cap wherein the recess comprises a slot.

The cap wherein the top wall is generally planar and has a diameter greater than a diameter of the cylindrical projection.

The cap wherein the top wall has a plurality of planar projections disposed circumferentially around the top wall and extending beyond the diameter of the top wall.

The cap wherein at least one of the plurality of planar projections is configured to be received in a centrally disposed recess of a second cap, wherein the centrally disposed recess of the second cap comprises a slot.

The cap wherein the cylindrical projection comprises an outer surface comprising the screw thread.

The cap wherein the cylindrical projection comprises a central cylindrical recess defining an inner surface of the cylindrical projection wherein the inner surface comprises a second screw thread.

The cap wherein the top wall has a diameter equivalent to a diameter of the cylindrical projection wherein the cylindrical projection comprises a central cylindrical recess defining a sidewall extending downward from the top wall comprising an inner surface of the cylindrical projection wherein the inner surface comprises the screw thread.

The cap wherein the side wall further comprises a circumferential shelf at the bottom of the sidewall disposed perpendicularly outward from the sidewall and a circumferential flange disposed at the outer edge of the shelf disposed downwardly from the shelf, the flange having an inner surface and an outer surface.

The cap further comprising a plurality of projections circumferentially disposed on the inner surface of the flange, each projection extending from the bottom of the circumferential shelf to the edge of the circumferential flange.

The cap further comprising a plurality of projections circumferentially disposed on an outer surface of the sidewall, each projection extending from a top surface of the circumferential shelf to the top surface of the top wall.

The cap further comprising a second cylindrical projection centrally disposed on the bottom surface of the top wall wherein the outer surface of the second cylindrical projection is spaced apart from the inner surface of the sidewall and comprises a second screw thread.

The cap wherein the second cylindrical projection is configured to be releasable engaged to a second cap comprising a cylindrical projection comprising a central cylindrical recess having an inner surface wherein the inner surface comprises a screw thread by inserting the second cylindrical projection into the central cylindrical recess and engaging the screw thread on the outer surface of the second cylindrical projection to the screw thread on the inner surface of the cylindrical recess of the second cap.

The cap wherein the top wall comprises a central boss and two depressions disposed between the central boss and a perimeter of the top wall, wherein the recess is disposed in the central boss.

Also provided is a kit comprising a first cap for closing an opening in a lid for a container wherein the first cap comprises a generally planar circular top wall having a top surface and a bottom surface, wherein the top surface comprises a centrally disposed recess configured to receive a tool to rotate the cap; and a cylindrical projection on the bottom surface comprising a screw thread configured to engage a complementary surface at the perimeter of the opening in the lid wherein the cylindrical projection comprises an outer surface comprising the screw thread; wherein the top wall has a diameter greater than a diameter of the cylindrical projection and comprises a plurality of planar projections disposed circumferentially around the top wall and extending beyond the diameter of the top wall; and a second cap for closing an opening in a lid for a container wherein the second cap comprises a generally circular top wall having a top surface and a bottom surface, wherein the top surface comprises a centrally disposed recess configured to receive a tool to rotate the cap; and a cylindrical projection on the bottom surface comprising a screw thread configured to engage a complementary surface at the perimeter of the opening in the lid; wherein the top wall has a diameter equivalent to a diameter of the cylindrical projection wherein the cylindrical projection comprises a central cylindrical recess defining a sidewall extending downward from the top wall comprising an inner surface of the cylindrical projection wherein the inner surface comprises the screw thread.

Embodiments of the kit include the following alone or in any combination.

The kit wherein the second cap further comprises a circumferential shelf at the bottom of the sidewall disposed perpendicularly outward from the sidewall and a circumferential flange disposed at the outer edge of the shelf disposed downwardly from the shelf, the flange having an inner surface and an outer surface and a plurality of projections circumferentially disposed on the inner surface of the flange, each projection extending from the bottom of the circumferential shelf to the edge of the circumferential flange.

The kit wherein the second cap further comprises a plurality of projections circumferentially disposed on an outer surface of the sidewall, each projection extending from a top surface of the circumferential shelf to the top surface of the top wall.

The kit wherein the cylindrical projection of the first cap further comprises a central cylindrical recess defining an inner surface of the cylindrical projection wherein the inner surface comprises a third screw thread; and the second cap further comprises a second cylindrical projection centrally disposed on the bottom surface of the top wall wherein the outer surface of the second cylindrical projection is spaced apart from the inner surface of the sidewall and comprises a fourth screw thread; wherein the second cap is configured to be releasably engaged to the first cap by inserting the second cylindrical projection of the second cap into the central cylindrical recess of the first cap and engaging the fourth screw thread on the outer surface of the second cylindrical projection to the third screw thread on the inner surface of the cylindrical recess of the first cap.

DETAILED DESCRIPTION OF THE DISCLOSED SUBJECT MATTER

As used herein the terms "top", "bottom", "inner," "outer," "up," "down" and the like refer to directions or portions of the caps disclosed herein when they are oriented to engage a lid of a container.

This disclosure relates to port closures for a removable lid of the type used on commercial-sized containers, such as cans, buckets, barrels, drums, etc. for holding paint, stains, oils, grease, bulk foodstuffs and the like. Such lids generally have a central lid area with parallel upper and lower surfaces and a continuous, inverted U-shaped channel extending about the periphery of the lower surface, the channel having inner and outer walls for releasably receiving therebetween the upper lip of the container. A skirt downwardly depends about the periphery of the lid area, the skirt forming part of the outer wall of the channel. Usually means are provided at the bottom of the channel to act as a seal between the lid and the container when the lid is in position on the container. Such containers, for example, may have a capacity of about five-gallons. They are often stacked for storage purposes, and consequently the lids must be of very sturdy construction.

Since the containers must be stackable for storage, shipping and the like, the lids, which are generally constructed of plastic, must be capable of supporting the stacked containers. Presently, such lids have been able to achieve the necessary strength through a support system that mandates that the central part of the lid, involving almost the entire upper surface of the lid, is recessed below its perimeter portions. As discussed above, the lids often include a tint port opening that is closed with a removable cap. To allow for a general planar top surface for the lids, the caps need to have a low profile so that they do not extend above the top level of the lids.

Disclosed herein are caps for closing an opening in a lid for a container wherein the caps comprises a generally circular top wall having a top surface and a bottom surface, wherein the top surface comprises a centrally disposed recess configured to receive a tool to rotate the cap; and a cylindrical projection on the bottom surface comprising a screw thread configured to engage a complementary surface at the perimeter of the opening in the lid.

FIGS. 1A to 1E depict illustrations of a cap according to a first exemplary embodiment. This embodiment is configured to engage a container lid having an opening with a simple perimeter, without a well or threaded collar.

Figure 1A:
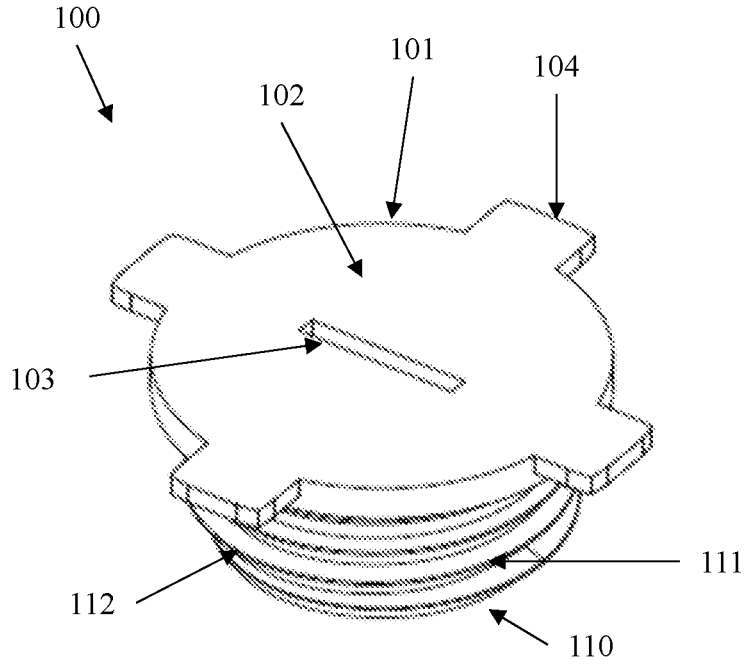
FIGS. 1A to 1E depict illustrations of a cap according to a first exemplary embodiment of the disclosed subject matter.

FIG. 1A shows a top perspective view of a first exemplary embodiment. The cap 100 comprises a generally planar, circular top wall 101 having a top surface 102 and a bottom surface. The top surface 102 comprises a centrally disposed recess 103 configured to receive a tool to rotate the cap for loosening or tightening the cap in the tint port of the lid. In the embodiment shown, the recess comprises a slot that can receive a slot or flat-headed screwdriver or the flat blade of a 5-in-1 painter's tool. Alternate configurations include a cross-shaped recess that can receive cross-head screwdrivers such as Phillips or Pozidriv screwdrivers, a square recess that can receive a square-head screwdriver, a hexagonal recess that can receive a hex-head screwdriver or Allen wrench, or a star-shaped recess that can receive star-head screwdrivers, also known as pointed screwdrivers, six-point screwdrivers or Torx screwdrivers.

Optionally, the top wall comprises a plurality of planar projections 104 disposed circumferentially around the top wall and extending beyond the diameter of the top wall. In the embodiment shown, the cap comprises four projections equally spaced around the circumference or perimeter of the top wall. Also in this illustrated embodiment, the projections are identical and are generally square or rectangular, optionally with rounded corners. However, these embodiments are not limiting and other variants are envisioned. For example, the projections need not be identical. Notably, at least one of the plurality of planar projections 104 may be configured to be received in a centrally disposed slot of a second cap. In this embodiment, the cap constitutes a tool that can be used like a flat-head screwdriver to apply torque to the second cap for tightening or loosening the cap in the tint port (See FIG. 1E).

Figure 1B:
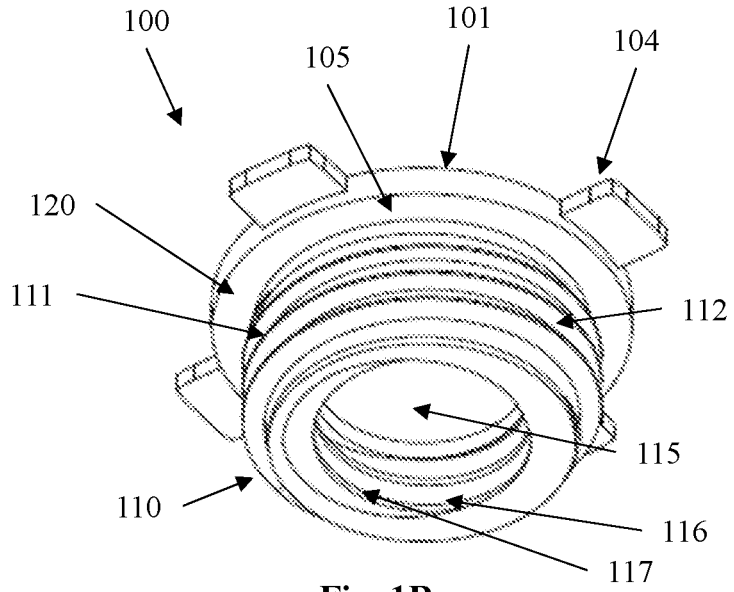

As shown in a bottom perspective view in FIG. 1B, the cap 100 comprises a cylindrical projection 110 disposed on the bottom surface 105 of the top wall 101 wherein the cylindrical projection 110 comprises an outer surface 111 comprising a screw thread 112 configured to engage a complementary surface at the perimeter of an opening in the lid of a container. To close the opening, the cylindrical projection 111 is inserted into the opening so that the screw thread engages the perimeter of the opening. Rotating the cap clockwise brings the cap down into the opening to seal the opening. Rotating the cap counterclockwise disengages the cap from the lid. In some embodiments (not shown), the cylindrical projection 110 comprises a solid surface defining a bottom wall of the cap. Preferably, the cylindrical projection comprises a central cylindrical recess 115 defining an inner surface 116 of the cylindrical projection. The recess may reduce the amount of material used in the cap. In the embodiment shown, the inner surface comprises a second screw thread 117. This second screw thread 117 allows a cap of this first embodiment to be releasably engaged to a cap of a second embodiment as described further below.

Also as shown in FIG. 1B, the top wall 101 has a diameter greater than the diameter of the cylindrical projection 110, providing a circumferential projection 120 that can be releasably engaged with the top surface of a container lid to provide a seal for the container when the cylindrical projection is inserted into the opening of the lid and screwed down. Optionally, the circumferential projection can comprise an integral sealing surface (not shown) comprising an elastomeric material coated onto the circumferential projection. Optionally and alternatively, an elastomeric annular ring or gasket (not shown) can be fitted around the cylindrical projection 110 to contact the circumferential projection 120 and provide a sealing surface. In either optional alternative, the sealing surface is configured to engage the top surface of the container lid and facilitate forming a hermetic seal between the cap and the lid.

Figure 1C:
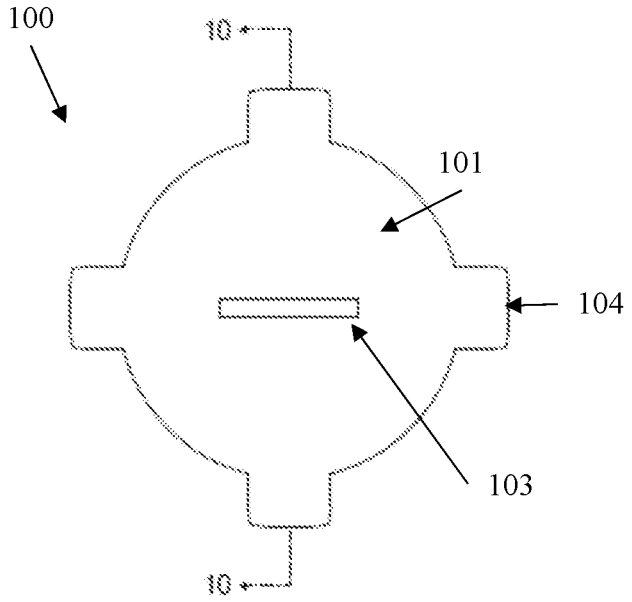
Figure 1D:
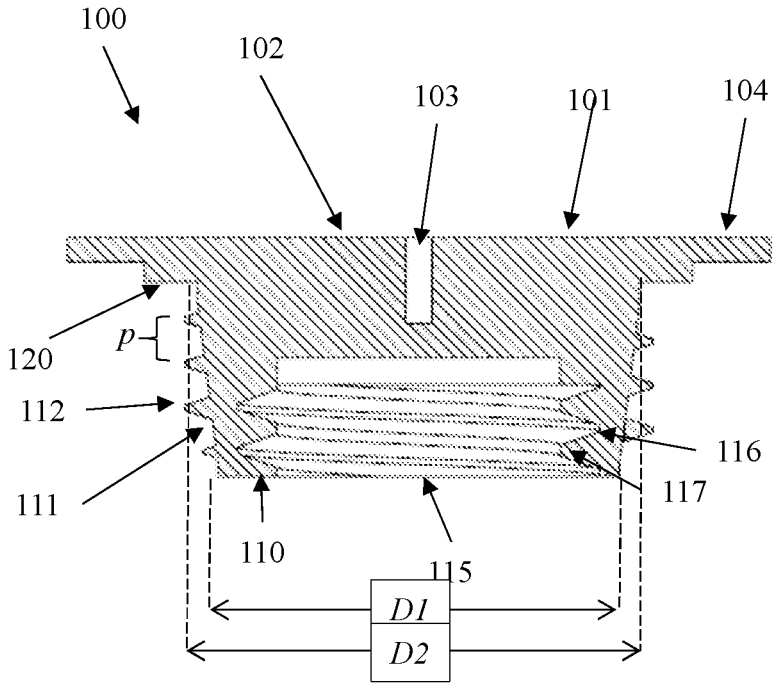

FIG. 1C shows a top view if cap 100. FIG. 1D shows a cross-section taken along line 10-10 of FIG. 1C. The cylindrical projection 110 of cap comprises a taper wherein the bottom of the tapered cylinder has a diameter D1 that is smaller than the diameter D2 at the top of the cylindrical projection (i.e. the cylindrical projection is configured as a truncated cone). D2 is configured to be approximately the same as or slightly larger than the diameter of the opening in the lid to facilitate forming a tight seal with the opening in the lid. For a lid for a 5-gallon (20-liter) paint bucket D2 is about 5 cm. The taper facilitates insertion of the cap into the opening of the lid. The pitch (p), or distance from the crest of one thread to the next, is equivalent to the thickness of the lid at the perimeter of the opening in the lid.

Figure 1E:
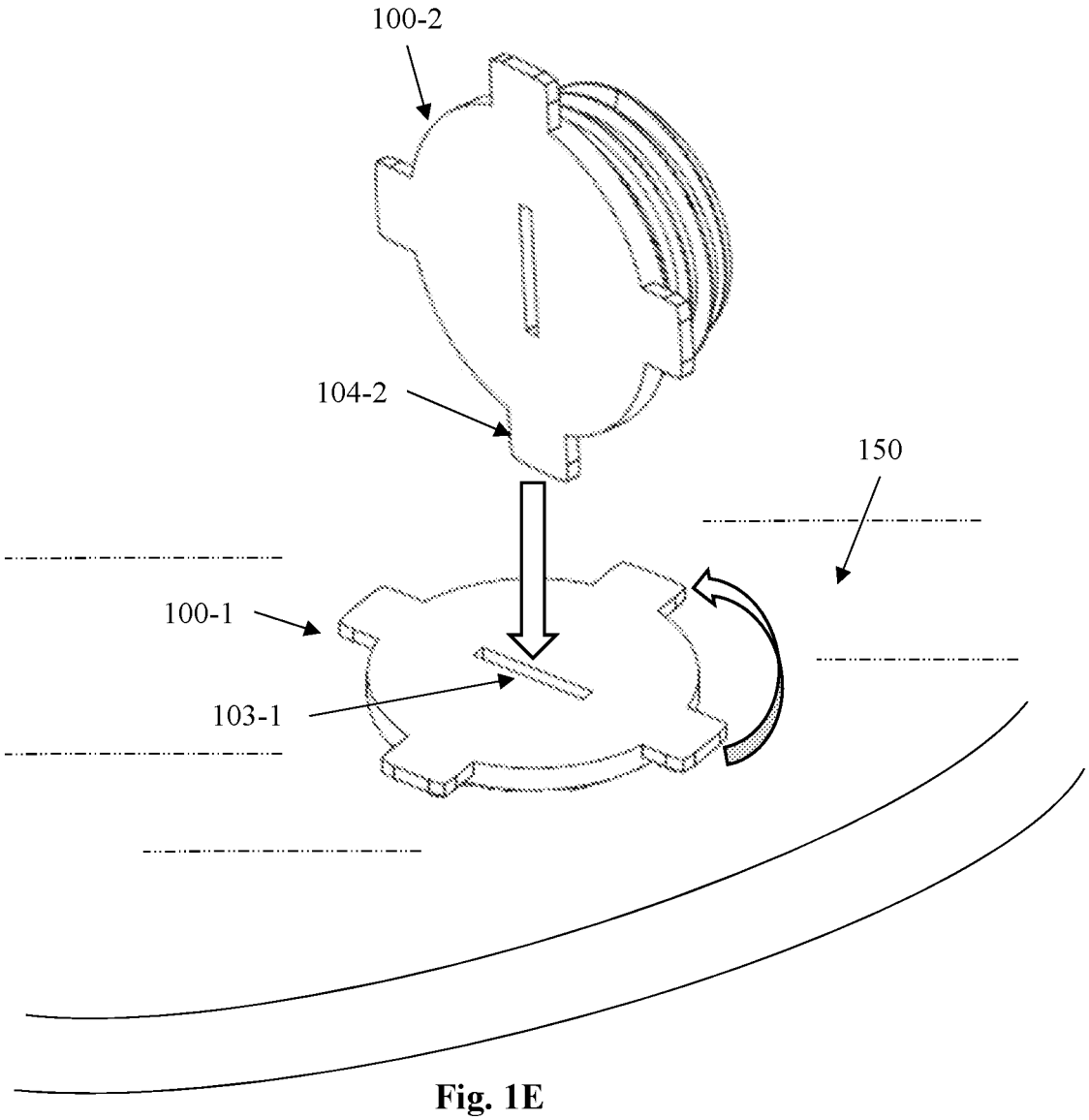

FIG. 1E shows a first cap 100-1 inserted in the opening of a paint bucket lid 150. A projection 104-2 on a second cap can 100-2 be inserted into the slot 103-1 of the first cap 100-1 and can be used to provide a rotational force (e.g. in a counterclockwise direction) to disengage the first cap 100-1 from the lid 150. In this way, a cap according to the first embodiment provides a tool that can be used for opening and removing another cap that comprises a slot in its top surface.

FIGS. 2A to 2D depict illustrations of a cap according to a second exemplary embodiment. This embodiment is configured to engage a container lid having an opening with a well and threaded collar.

Figure 2A:
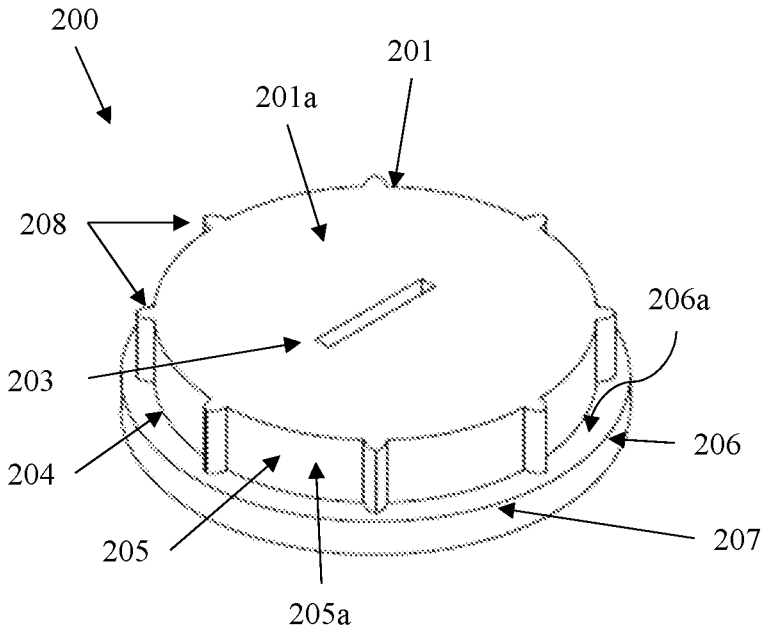
FIGS. 2A to 2G depict illustrations of a cap according to a second exemplary embodiment of the disclosed subject matter.
Figure 2B:
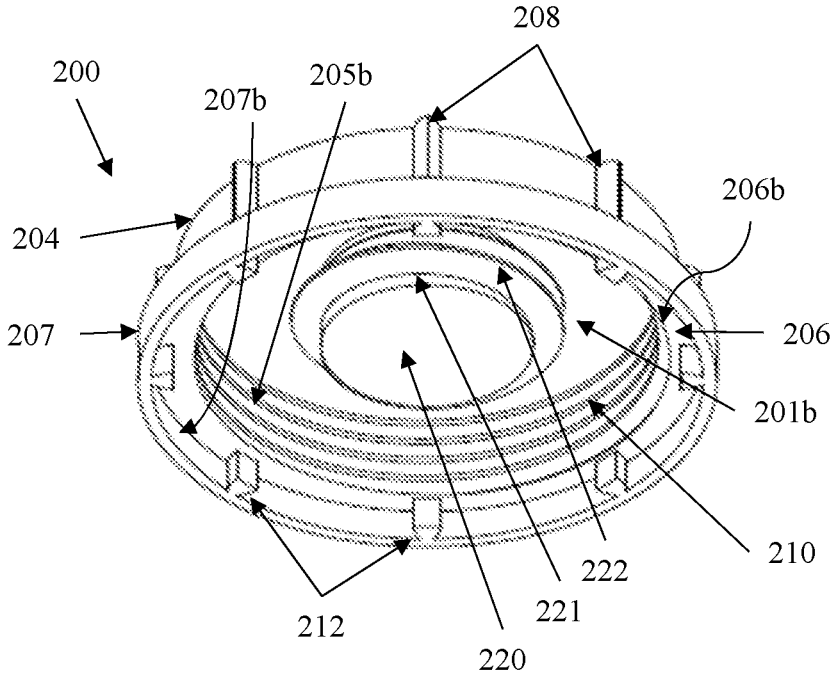

In this embodiment, as shown by a top perspective view in FIG. 2A, the cap 200 comprises a generally planar, circular top wall 201 having a top surface 201*a* and a bottom surface 201*b* (See FIG. 2B). The top wall 201 comprises a centrally disposed recess 203 configured to receive a tool to rotate the cap for loosening or tightening the cap in the tint port of a container lid. In the embodiment shown, the recess 203 comprises a slot, but other recesses may be envisioned as described above. Notably, a projection 104 of cap 100 can engage the slot 203 of a cap 200 to rotate the cap 200 to engage or disengage cap 200 from a container lid, similar to that shown in 1D. The cap also comprises a cylindrical projection 204 disposed on the bottom surface of .the top wall. The top wall 201 has a diameter equivalent to the diameter of the cylindrical projection 204 wherein the cylindrical projection 204 comprises a central cylindrical recess defining a sidewall 205 extending downward from the top wall (see also FIGS. 2B and 2D). The sidewall 205 is configured to be disposed within a well around a tint port on the container lid.

The cap 200 also comprises a circumferential shelf 206 at the bottom of the sidewall 205 disposed perpendicularly outward from the sidewall and a circumferential flange 207 disposed at the outer edge of the shelf 205 disposed downwardly from the shelf, the flange 207 having an inner surface and an outer surface. In the embodiment shown, the cap optionally comprises a plurality of projections 208 circumferentially disposed on the outer surface 205*a* of the sidewall 205, each projection 208 extending from the top surface 206*a* of the circumferential shelf 206 to the top surface 202 of the top wall 201. In FIG. 2A, eight projections 208 are shown, but that is not limiting. As shown, preferably the projections 208 comprise rounded ridges. The projections 208 provide gripper ribs to facilitate a user grasping the cap 200 to rotate it to engage it to or disengage it from a threaded collar at the perimeter of the opening of a container lid.

As shown in a bottom perspective view in FIG. 2B, the inner surface 205*b* of the sidewall 205 comprises a screw thread 210. The screw thread 210 is configured to be releasably engaged to a screw thread on the outer surface of a threaded collar on a container lid. Also as shown in FIG. 2B, the cap further comprises a plurality of projections 212 circumferentially disposed on the inner surface of the flange, each projection extending from the bottom surface 206*b* of the circumferential shelf to the edge of the circumferential flange. In FIG. 2B, eight projections 212 are shown, but that is not limiting. As shown, preferably the projections 212 comprise ridges with a roughly triangular profile, but that is not limiting. In other embodiments, the projections may comprise rounded ridges.

Also as shown in FIG. 2B, the cap 200 of the second embodiment comprises a projection 220 centrally disposed on the bottom surface 201*b* of the top wall 201 to provide a boss in which the slot 203 extends into from the top surface 201*a*. Preferably, the projection 220 comprises a second cylindrical projection wherein the outer surface 221 of the second cylindrical projection 220 is spaced apart from the inner surface 205*b* of the sidewall 205 and comprises a second screw thread 222. In this optional embodiment, the second screw thread 222 of the second cylindrical projection 220 is configured to be releasable engaged to the screw thread 117 in the central cylindrical recess 115 of a cap 100 of the first embodiment by inserting the second cylindrical projection 220 into the central cylindrical recess 115 and engaging the screw thread 222 of the second cylindrical projection 220 to the screw thread 117 on the inner surface 116 of the cylindrical recess 115 of the cap 100 of the first embodiment.

Also as shown in FIG. 2B, the bottom surface 201*b* of the top wall 201 extends inwardly from the sidewall 205, which can be releasably engaged with a top surface of a threaded collar around the perimeter of an opening in a lid to provide a seal for the container when the cap is placed in contact with the threaded collar of the lid and screwed down. Optionally, the bottom surface 201*b* can comprise an integral sealing surface (not shown) comprising an elastomeric material coated onto the bottom surface. Optionally and alternatively, an elastomeric annular ring or gasket (not shown) can be fitted within the sidewall 205 and provide a sealing surface. In embodiments wherein the cap comprises a second cylindrical projection 220, the integral sealing surface or the gasket is disposed between the sidewall 205 and the second cylindrical projection 220. In any of these alternatives, the sealing surface is configured to engage the top surface of the lid and facilitate forming a hermetic seal between the cap and the lid.

Figure 2C:
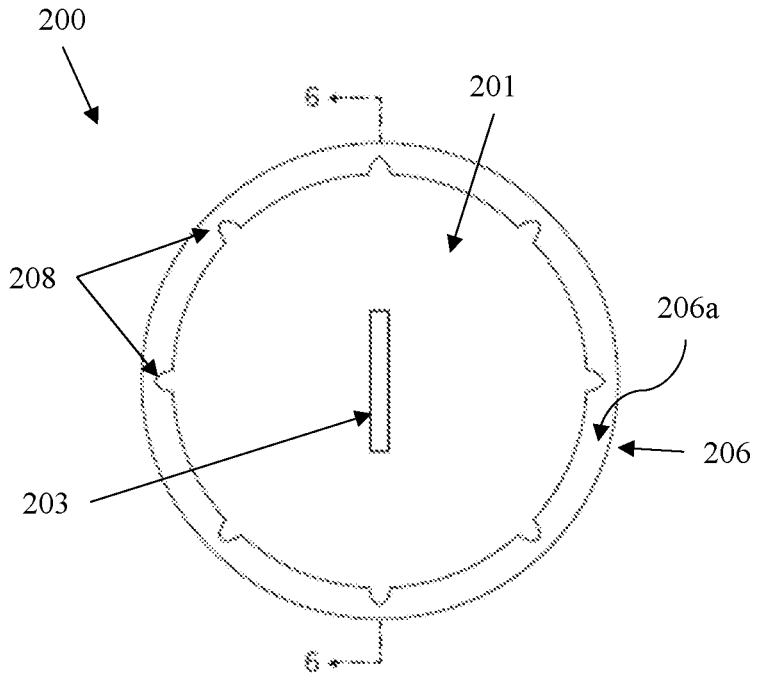
Figure 2D:
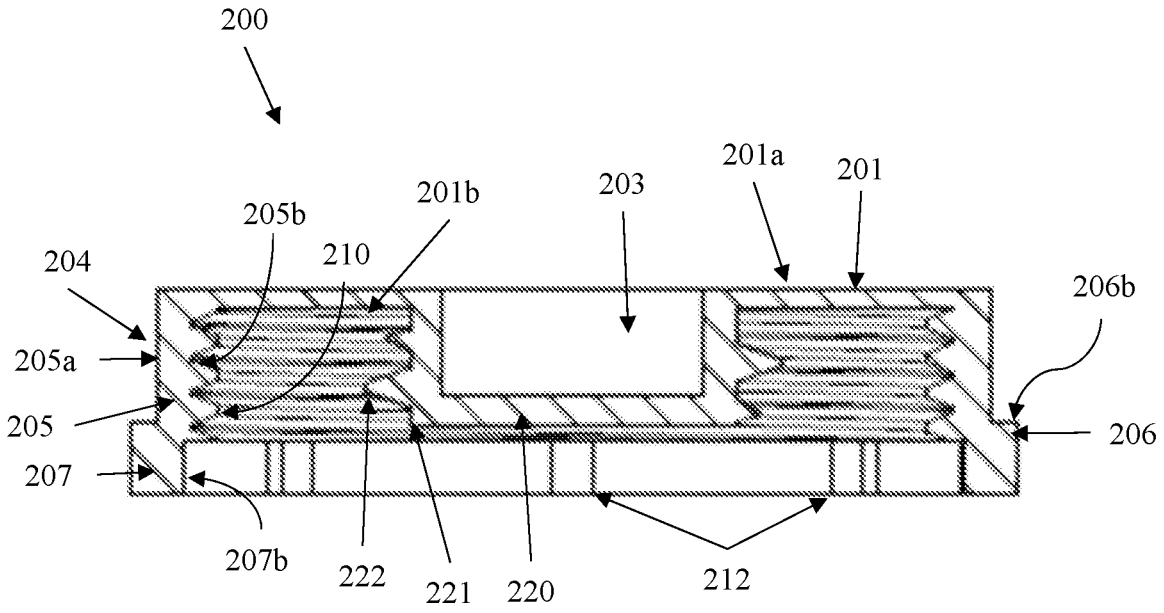

FIG. 2C shows a top view of cap 200. FIG. 2D shows a cross-section of cap 200 taken along line 6-6 in Figure C. In this cross-section view, the slot 203 extends down into the central projection 220. The sidewall 205 extends downward from the perimeter of the top wall 201 and comprises a screw thread 210 on its inner surface. Shelf 206 extends outwardly from sidewall 205 and flange 207 extends downwardly from shelf 206. Projections 212 on the inner surface 207*b* of flange 206 are shown. In the preferred embodiment shown, central projection 220 is cylindrical and comprises a screw thread 22 on it outer surface 221.

Figure 2E:
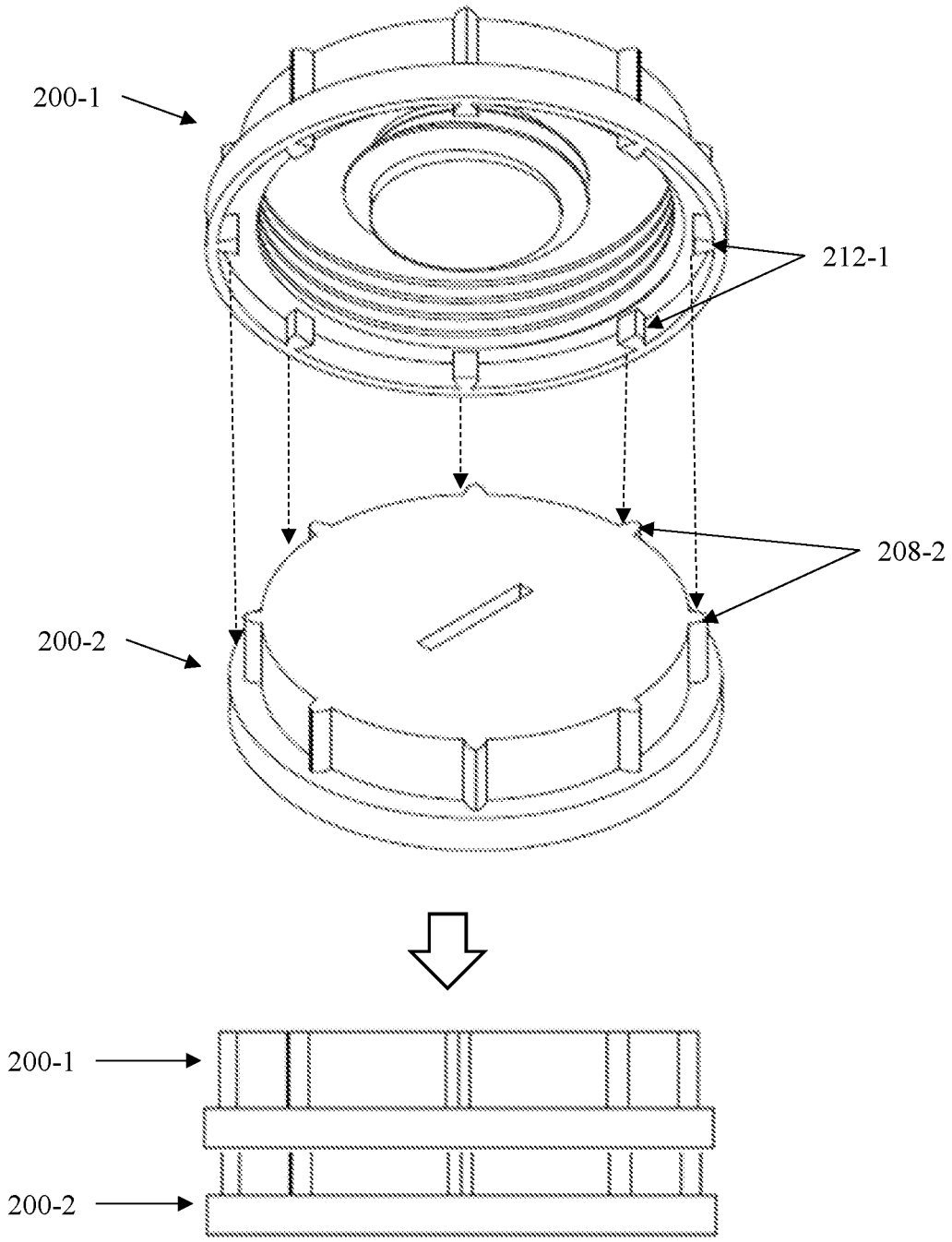

As shown in FIG. 2E, preferably, projections 212-1 on a first cap 200-1 are configured so that they can engage a plurality of projections (e.g. 208-2) on the outside surface of the sidewall of a second cap (e.g. a second cap 200-2)), as indicated by the dashed arrows, so that when the first cap 200-1 is positioned above the second cap 200-2 and projections 212-1 are engaged to projections 208-2, rotating the cap 200-1 can also rotate the second cap 200-2 so that it can engage to, or disengage from, a threaded collar on a container lid. In this way, a cap 200 according to the second embodiment provides a tool that can be used for opening and removing a second cap that comprises a plurality of projections on the outer surface of its sidewall.

Figure 2F:
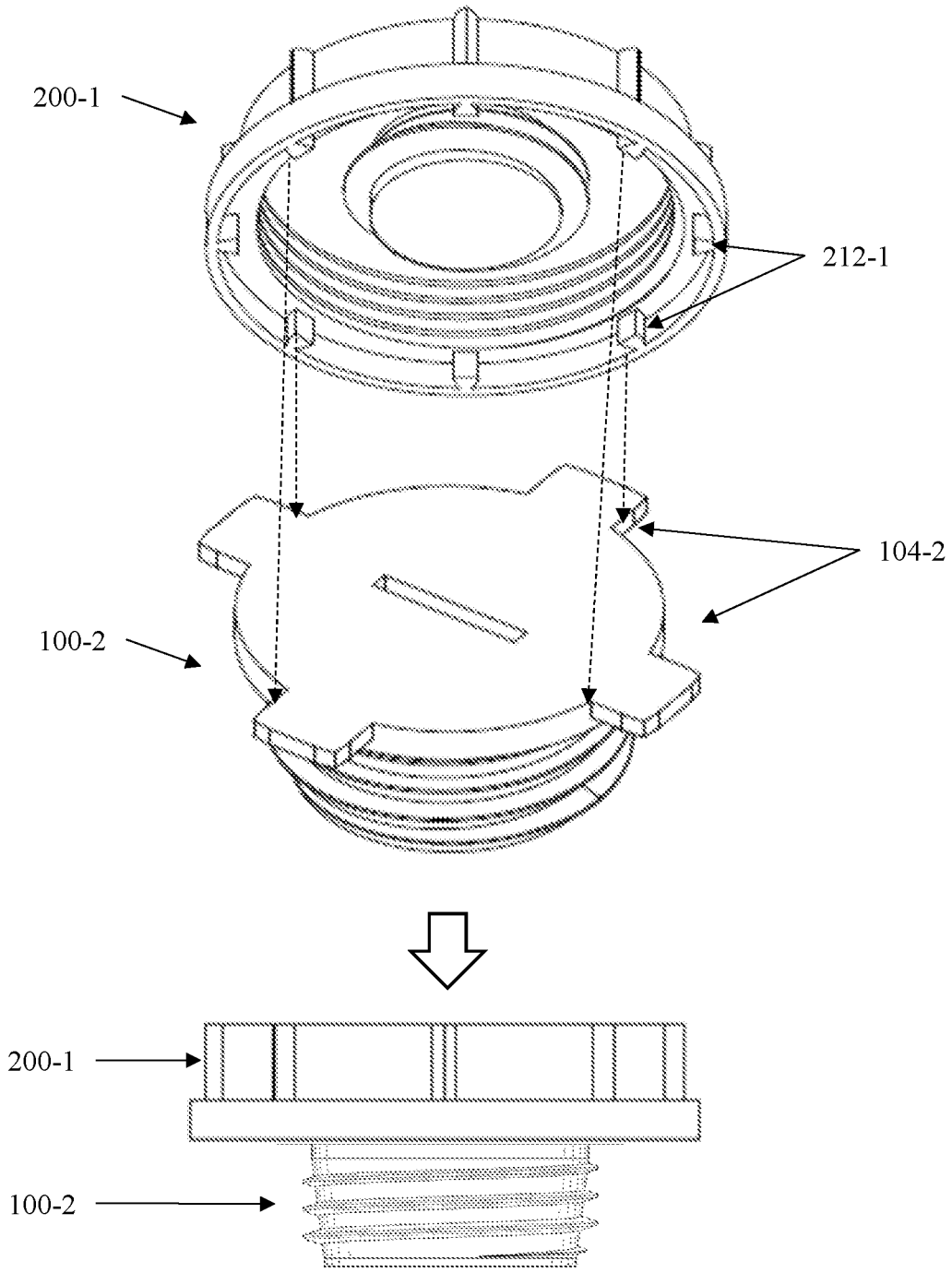

As shown in FIG. 2F, preferably, projections 212-1 on a first cap 200-1 are configured so that they can engage a plurality of projections (e.g. 104-2) on the top wall of a second cap (e.g. a second cap 100-2)), as indicated by the dashed arrows, so that when the first cap 200-1 is positioned above the second cap 100-2 and projections 212-1 are engaged to projections 104-2, rotating the cap 200-1 can also rotate the second cap 100-2 so that it can engage to, or disengage from, a threaded collar on a container lid. In this way, a cap 200 according to the second embodiment provides a tool that can be used for opening and removing a second cap that comprises a plurality of projections on its outer surface.

Figure 2G:
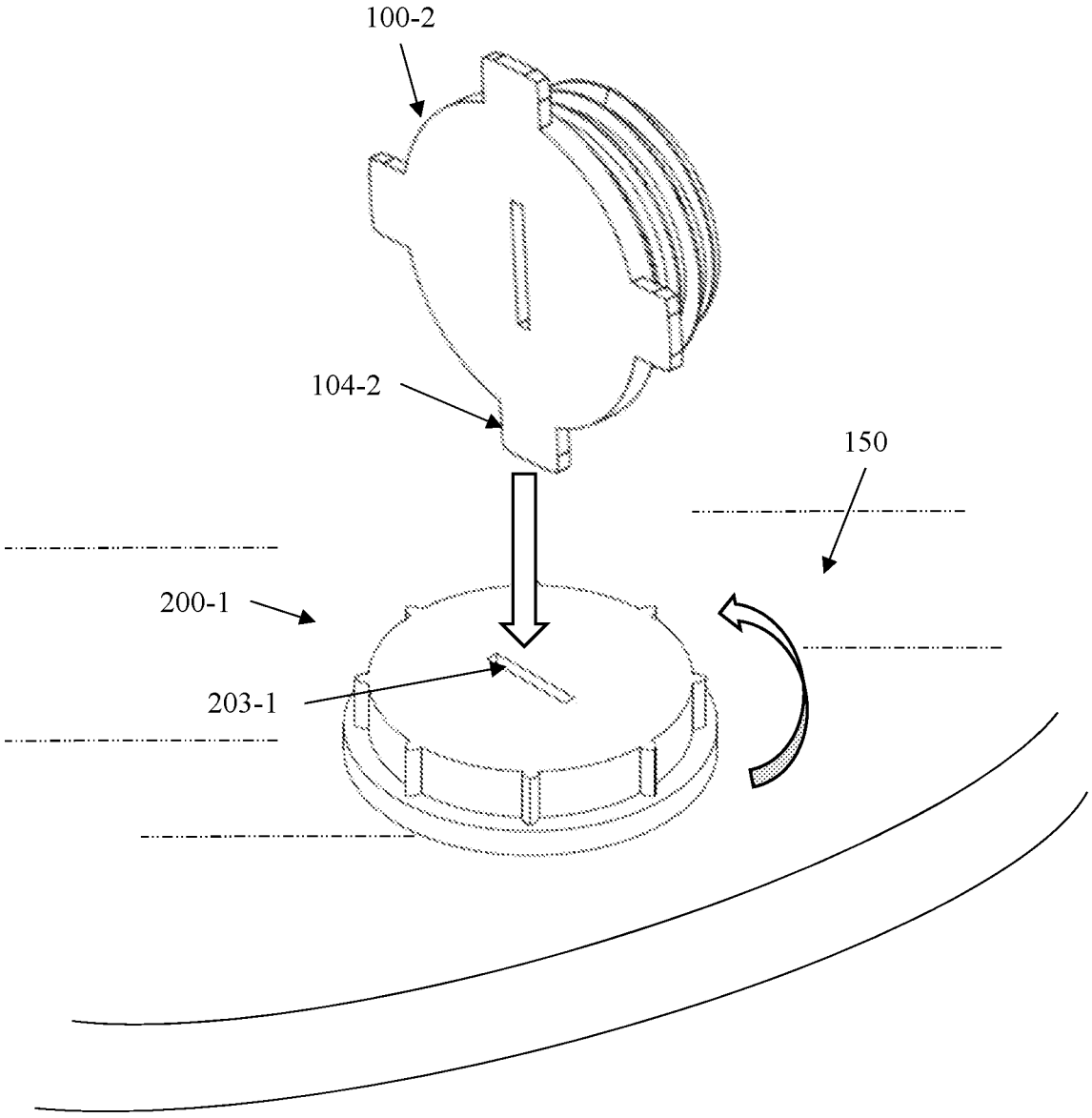

FIG. 2G shows a first cap 200-1 inserted in the opening of a paint bucket lid 150. A projection 104-2 on a second cap can 100-2 be inserted into the slot 203-1 of the first cap 200-1 and can be used to provide a rotational force (e.g. in a counterclockwise direction) to disengage the first cap 200-1 from the lid 150. In this way, a cap according to the first embodiment provides a tool that can be used for opening and removing another cap according to the second embodiment that comprises a slot in its top surface.

Figure 3A:
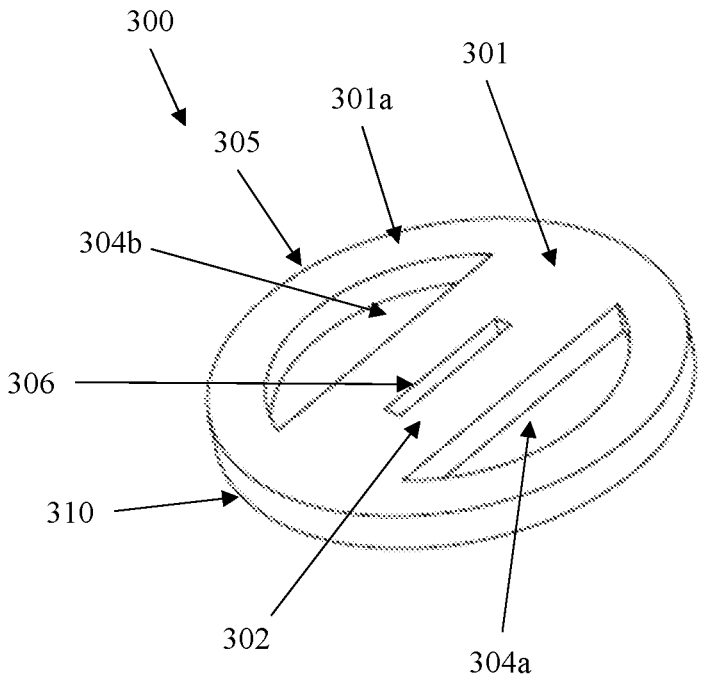
FIGS. 3A and 3B depict illustrations of a cap according to a third exemplary embodiment of the disclosed subject matter.
Figure 3B:
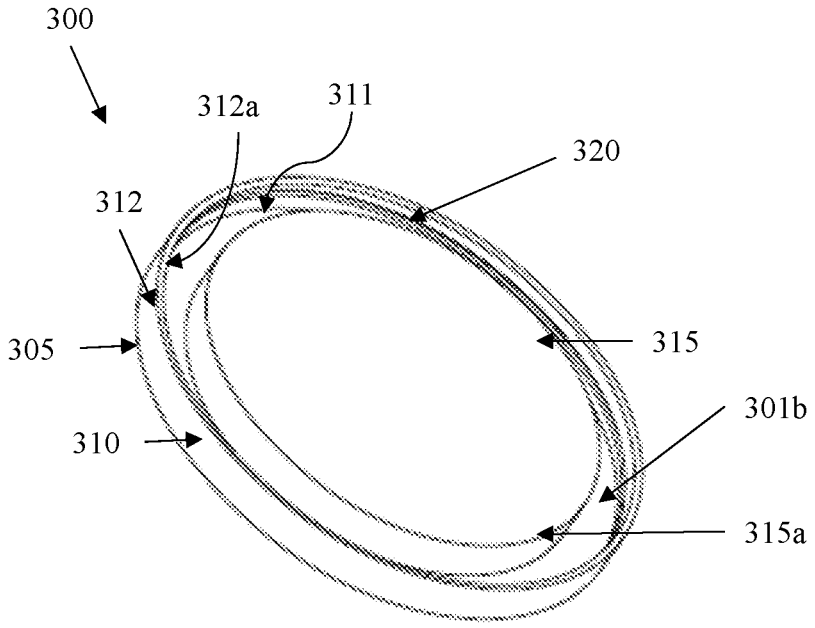

FIGS. 3A and 3B show top and bottom perspective views of a third embodiment of a cap for a container lid. In this embodiment, as shown in FIG. 3A, the cap 300 comprises a generally circular top wall 301 having a top surface 301*a* and a bottom surface 301*b* (See FIG. 3B), a central boss 302 and two depressions 304*a* and 304*b* disposed between the central boss 302 and the perimeter 305 of the top wall 301, wherein the top surface comprises a centrally disposed recess 306 disposed in the central boss. The depressions 304*a* and 304*b* are configured to provide a gripping surface to allow a user to insert a thumb and forefinger to rotate the cap. The recess 306 is configured to receive a tool to rotate the cap 300, as described above for the first embodiment of the cap. In the embodiment shown, the recess 306 comprises a slot, but other recesses may be envisioned as described above. Notably, a projection 104 of cap 100 can engage the slot 306 of a cap 300 to rotate the cap 300 to engage or disengage cap 300 from a container lid, similar to that shown in 1D.

The cap also comprises a cylindrical projection 310 disposed on the bottom surface 301*b* of the top wall 301. The top wall 301 has a diameter equivalent to the diameter of the cylindrical projection 310 wherein the cylindrical projection 310 comprises a central cylindrical recess 311 defining a sidewall 312 extending downward from the top wall from the perimeter 305 of top wall 301 (see also FIG. 3B). The sidewall 311 is configured to be disposed within a well around a tint port on the container lid.

As shown in a bottom perspective view in FIG. 3B, the cap 300 comprises a second cylindrical projection 315 centrally disposed on the bottom surface 301*b* of the top wall 301 to provide a boss in which the depressions 304*a* and 304*b* and slot 306 extends into from the top surface 301*a*. The projection 315 comprises an outer surface 315*a* that is spaced apart from the inner surface 312*a* of the sidewall 312.

The inner surface 312*a* of the sidewall 312 comprises a screw thread 320 configured to releasably engage a complementary surface of a collar at the perimeter of the opening in the container lid. When the cap 300 is inserted into an opening of a container lid and rotated, the screw thread 320 draws the cap 300 into the opening so that the bottom surface 301*b* of the top wall 301, the inner surface 312*a* of the sidewall 312, and the outer surface 315*a* of the cylindrical projection 315 engage a collar at the perimeter of the opening of the container lid.

Optionally, the bottom surface 301*b* can comprise an integral sealing surface (not shown) comprising an elastomeric material coated onto the bottom surface. Optionally and alternatively, an elastomeric annular ring or gasket (not shown) can be fitted between the sidewall 312 and the central projection 315 to provide a sealing surface. In any of these alternatives, the sealing surface is configured to engage the top surface of the lid and facilitate forming a hermetic seal between the cap and the lid.

In the embodiment shown, the cap 300 is sized to fit in a tint port of a lid for a 1-gallon (4-liter) paint can, but this is not limiting.

The caps are of integral plastic construction and may be made from polylactic acid (PLA), polyethylene terephthalate glycol (PETG), polyamides (nylon), Acrylonitrile butadiene styrene (ABS) or polyethylene plastic, such as low density polyethylene (LDPE) or high density polyethylene (HDPE). The caps may be 3D-printed or injection molded. As described in the Examples, 3D printed caps have been prepared from polylactic acid (PLA), polyethylene terephthalate glycol (PETG), polyamides (nylon) or Acrylonitrile butadiene styrene (ABS). Injection-molded caps may be prepared preferably from polyethylene, such as LDPE or HDPE.

The invention also provides a kit comprising a first cap (e.g. a cap 100) for closing an opening in a lid for a container wherein the first cap comprises a generally planar circular top wall having a top surface and a bottom surface, wherein the top surface comprises a centrally disposed recess configured to receive a tool to rotate the cap; and a cylindrical projection on the bottom surface comprising a screw thread configured to engage a complementary surface at the perimeter of the opening in the lid wherein the cylindrical projection comprises an outer surface comprising the screw thread; wherein the top wall has a diameter greater than a diameter of the cylindrical projection and comprises a plurality of planar projections disposed circumferentially around the top wall and extending beyond the diameter of the top wall; and a second cap for closing an opening in a lid for a container wherein the second cap (e.g. a cap 200) comprises a generally circular top wall having a top surface and a bottom surface, wherein the top surface comprises a centrally disposed recess configured to receive a tool to rotate the cap; and a cylindrical projection on the bottom surface comprising a screw thread configured to engage a complementary surface at the perimeter of the opening in the lid; wherein the top wall has a diameter equivalent to a diameter of the cylindrical projection wherein the cylindrical projection comprises a central cylindrical recess defining a sidewall extending downward from the top wall comprising an inner surface of the cylindrical projection wherein the inner surface comprises the screw thread.

Notably, the cylindrical projection of the first cap further comprises a central cylindrical recess defining an inner surface of the cylindrical projection wherein the inner surface comprises a third screw thread; and the second cap further comprises a second cylindrical projection centrally disposed on the bottom surface of the top wall wherein the outer surface of the second cylindrical projection is spaced apart from the inner surface of the sidewall and comprises a fourth screw thread; wherein the second cap is configured to be releasably engaged to the first cap by inserting the second cylindrical projection of the second cap into the central cylindrical recess of the first cap and engaging the fourth screw thread on the outer surface of the second cylindrical projection to the third screw thread on the inner surface of the cylindrical recess of the first cap.

The kit may further comprise packaging and instructions for using the two caps (e.g. caps 100 and 200). The kit may also further comprise a cap 300.

Figure 4A:
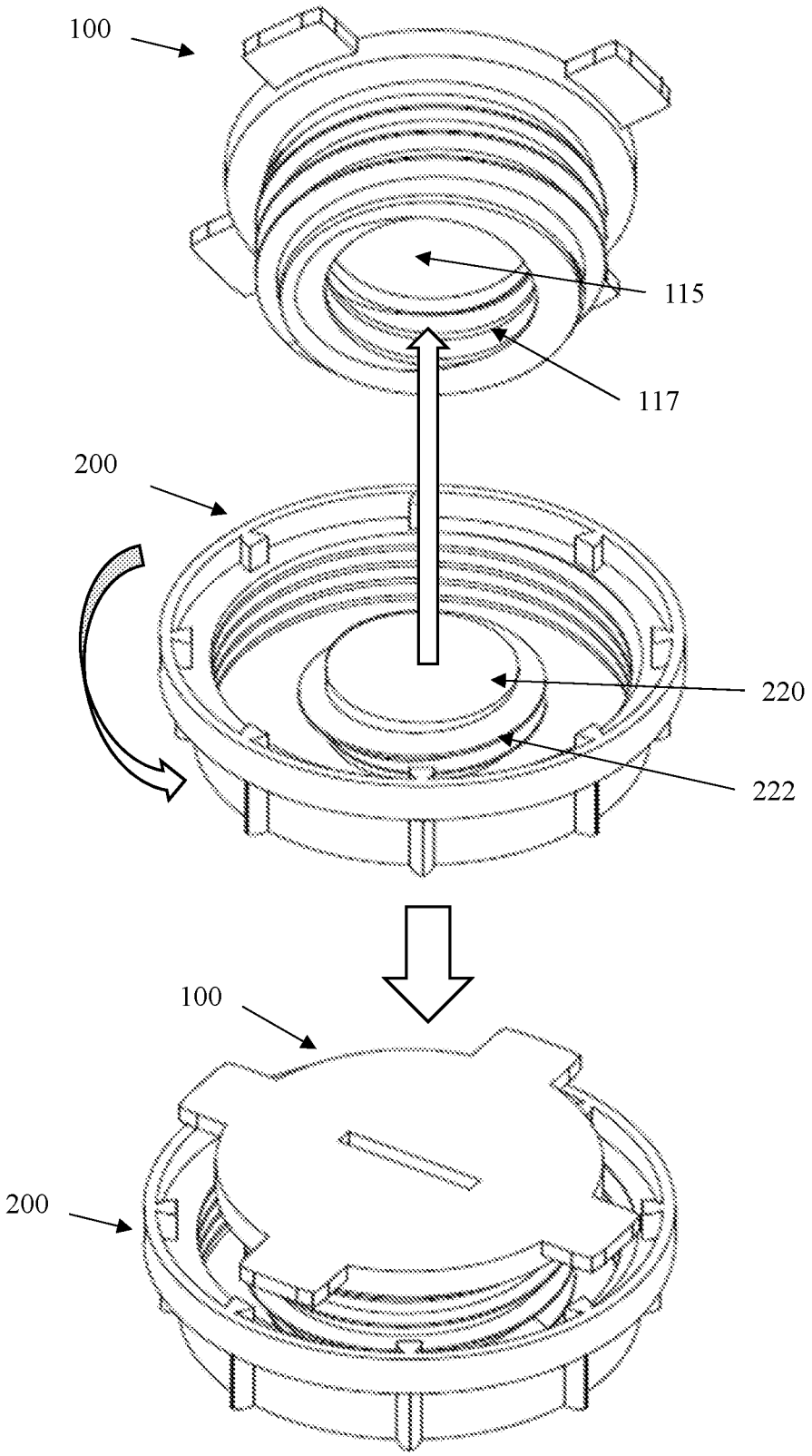
FIGS. 4A to 4D depict illustrations of how caps of the first and second embodiments can interconnect or interlock according to an exemplary embodiment of the disclosed subject matter.
Figure 4B:
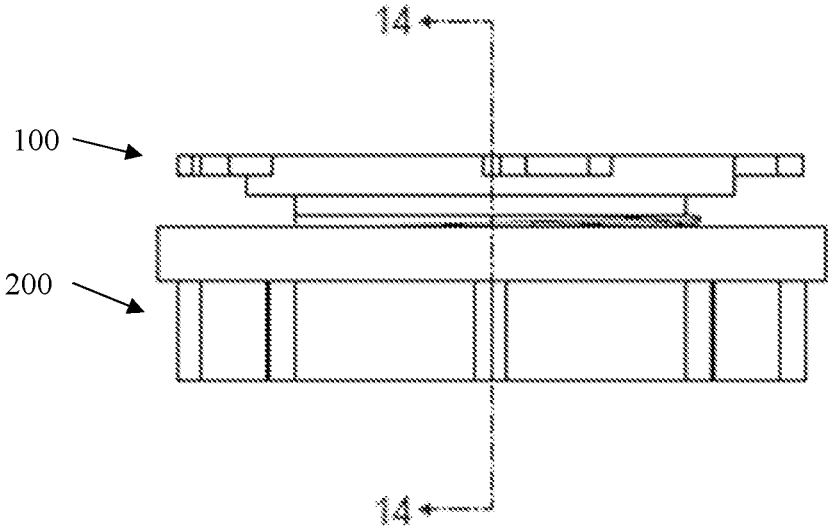
Figure 4C:
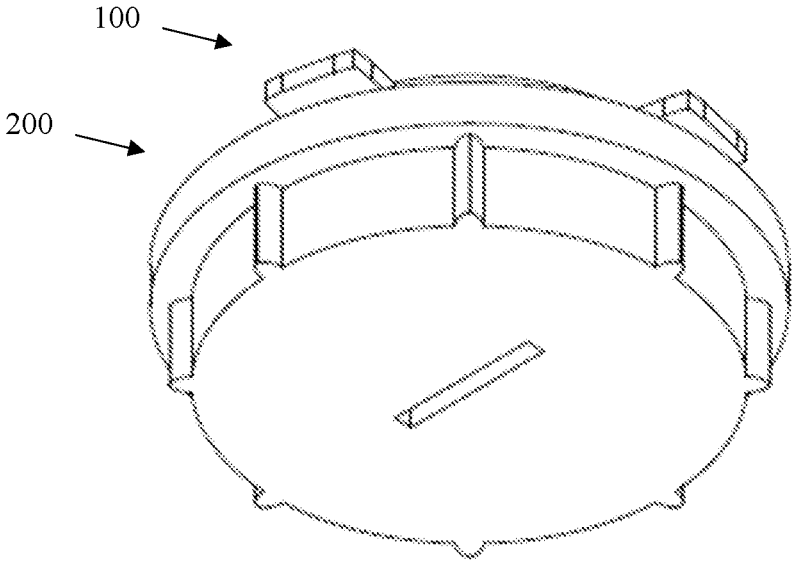

As shown in FIG. 4A, caps 100 and caps 200 are configured to be releasably engaged to each other to provide a coupled or interlocked combination. When the central cylindrical projection 220 of cap 200 is inserted into the central recess 115 of cap 100 so that screw thread 222 contacts screw thread 117 of cap 100, rotation of cap 200 releasably engages the screw threads 222 and 117 to lock caps 100 and 200 together, as shown in top perspective view at the bottom of FIG. 4A. FIGS. 4B and 4C show side and bottom perspective views of the combined caps 100 and 200.

Figure 4D:
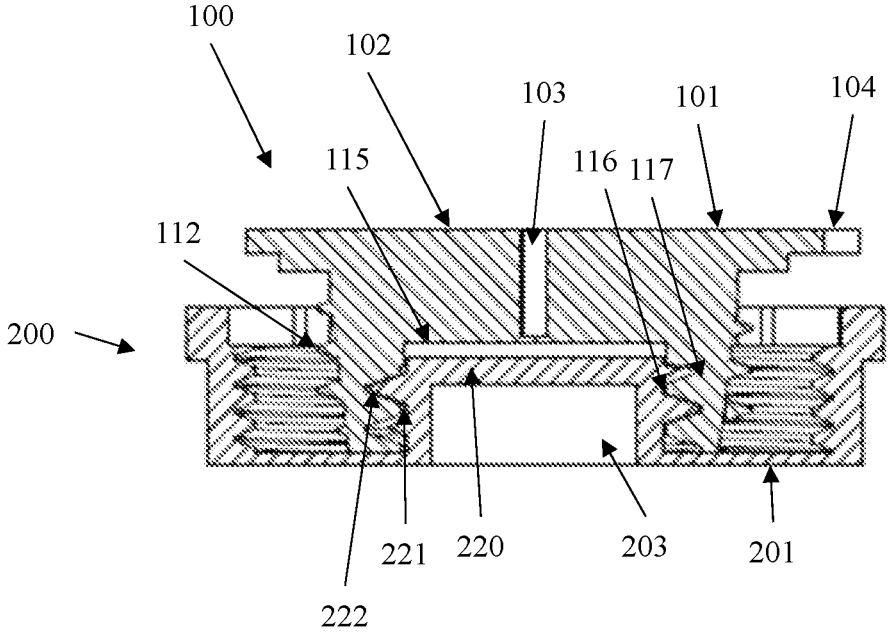

FIG. 4D shows a cross-section of the joined caps 100 and 200 taken along line 14-14 of FIG. 4B.

EXAMPLES

Example caps described herein were prepared by 3-D printing. The caps were designed in AutoDesk software, Tinkercad.com. They were printed on an Ender 3 Pro FDM 3D printer. Caps were printed using polylactic acid (PLA), polyethylene terephthalate glycol (PETG), polyamides (nylon) or Acrylonitrile butadiene styrene (ABS). The nozzle temperature was set at 202° celsius and the bed temperature was set at 60° celsius. Print speeds vary during the process between 20-60 mm/s. The layer height was 0.2 mm from a 0.4 mm nozzle. Supports were used in areas touching the build plate. Slicing software was Cura 4.8.

The invention claimed is:

1. A cap for closing an opening in a lid for a container wherein the cap comprises a generally circular top wall having a top surface and a bottom surface, wherein the top surface comprises a centrally disposed recess configured to receive a tool to rotate the cap; and a truncated cone projection on the bottom surface having a first diameter proximate the bottom surface of the top wall and a second diameter distal from the top wall wherein the first diameter is larger than the second diameter and the same as or slightly larger than a diameter of the opening in the lid; the truncated cone projection comprising a screw thread on its outer surface configured to engage a complementary surface at the perimeter of the opening in the lid wherein the pitch of the screw thread is equal to or larger than a thickness of the lid at the opening;

wherein the top wall has a diameter greater than the first diameter of the truncated cone projection.

2. The cap of claim 1 wherein the centrally disposed recess comprises a slot.

3. The cap of claim 1 wherein the top wall has a plurality of planar projections disposed circumferentially around the top wall and extending beyond the diameter of the top wall.

4. The cap of claim 3 wherein at least one of the plurality of planar projections is configured to be a tool for rotating a second cap, wherein the tool is configured to be received in a centrally disposed recess of the second cap comprising a slot.

5. The cap of claim 1 wherein the truncated cone projection comprises a central cylindrical recess defining an inner surface of the truncated cone projection wherein the inner surface comprises a second screw thread.

6. A cap of for closing an opening in a lid for a container wherein the cap comprises a top wall having a top surface and a bottom surface, wherein the top surface comprises a centrally disposed recess configured to receive a tool to rotate the cap; a sidewall extending downward from the top wall at a perimeter of the top wall comprising an inner surface wherein the inner surface comprises a first screw thread; and a cylindrical projection centrally disposed on the bottom surface of the top wall wherein the outer surface of the cylindrical projection is spaced apart from the inner surface of the sidewall and comprises a second screw thread.

7. The cap of claim 6 wherein the centrally disposed recess comprises a slot.

8. The cap of claim 6 wherein the side wall further comprises a circumferential shelf at the bottom of the sidewall disposed perpendicularly outward from the sidewall and a circumferential flange disposed at the outer edge of the shelf disposed downwardly from the shelf, the flange having an inner surface and an outer surface.

9. The cap of claim 8 further comprising a plurality of projections circumferentially disposed on the inner surface of the flange, each projection extending from the bottom of the circumferential shelf to the edge of the circumferential flange.

10. The cap of claim 8 further comprising a plurality of projections circumferentially disposed on an outer surface of the sidewall, each projection extending from a top surface of the circumferential shelf to the top surface of the top wall.

11. The cap of claim 6 wherein the cylindrical projection is configured to be releasable engaged to a second cap comprising a cylindrical projection comprising a central cylindrical recess having an inner surface wherein the inner surface comprises a screw thread by inserting the cylindrical projection into the central cylindrical recess and engaging the screw thread on the outer surface of the cylindrical projection to the screw thread on the inner surface of the cylindrical recess of the second cap.

12. The cap of claim 6 wherein the top wall comprises a central boss and two depressions disposed between the central boss and a perimeter of the top wall, wherein the recess is disposed in the central boss.

13. The cap of claim 12 wherein the recess comprises a slot.

14. A kit comprising (a) a first cap for closing an opening in a lid for a container wherein the first cap comprises a generally planar circular top wall having a top surface and a bottom surface, wherein the top surface comprises a centrally disposed recess configured to receive a tool to rotate the cap; and a cylindrical projection on the bottom surface comprising a screw thread configured to engage a complementary surface at the perimeter of the opening in the lid wherein the cylindrical projection comprises an outer surface comprising the screw thread;

wherein the top wall has a diameter greater than a diameter of the cylindrical projection and comprises a plurality of planar projections disposed circumferentially around the top wall and extending beyond the diameter of the top wall; and (b) a second cap for closing an opening in a lid for a container wherein the second cap comprises a generally circular top wall having a top surface and a bottom surface, wherein the top surface comprises a centrally disposed recess configured to receive a tool to rotate the cap; and a cylindrical projection on the bottom surface comprising a screw thread configured to engage a complementary surface at the perimeter of the opening in the lid;

wherein the top wall has a diameter equivalent to a diameter of the cylindrical projection wherein the cylindrical projection comprises a central cylindrical recess defining a sidewall extending downward from the top wall comprising an inner surface of the cylindrical projection wherein the inner surface comprises the screw thread.

15. The kit of claim 14 wherein the second cap further comprises a circumferential shelf at the bottom of the sidewall disposed perpendicularly outward from the sidewall and a circumferential flange disposed at the outer edge of the shelf disposed downwardly from the shelf, the flange having an inner surface and an outer surface and a plurality of projections circumferentially disposed on the inner surface of the flange, each projection extending from the bottom of the circumferential shelf to the edge of the circumferential flange.

16. The kit of claim 14 wherein the second cap further comprises a plurality of projections circumferentially disposed on an outer surface of the sidewall, each projection extending from a top surface of the circumferential shelf to the top surface of the top wall.

17. The kit of claim 14 wherein the cylindrical projection of the first cap further comprises a central cylindrical recess defining an inner surface of the cylindrical projection wherein the inner surface comprises a third screw thread; and the second cap further comprises a second cylindrical projection centrally disposed on the bottom surface of the top wall wherein the outer surface of the second cylindrical projection is spaced apart from the inner surface of the sidewall and comprises a fourth screw thread;

wherein the second cap is configured to be releasably engaged to the first cap by inserting the second cylindrical projection of the second cap into the central cylindrical recess of the first cap and engaging the fourth screw thread on the outer surface of the second cylindrical projection to the third screw thread on the inner surface of the cylindrical recess of the first cap.

18. The kit of claim 14 wherein the cylindrical projection on the bottom surface of the top wall of the first cap has a diameter proximate the bottom surface of the top wall that is the same as or slightly larger than a diameter of the opening in the lid; and the pitch of the screw thread is equal to or larger than a thickness of the lid at the opening.

19. The kit of claim 18 wherein the cylindrical projection is configured as a truncated cone wherein the diameter proximate the bottom surface of the top wall is larger than a diameter of the projection distal from the bottom surface of the top wall.

* * * * *